US009654885B2

(12) United States Patent
Natarajan

(10) Patent No.: US 9,654,885 B2
(45) Date of Patent: *May 16, 2017

(54) METHODS AND APPARATUS FOR ALLOCATING FEEDBACK CANCELLATION RESOURCES FOR HEARING ASSISTANCE DEVICES

(71) Applicant: Starkey Laboratories, Inc., Eden Prairie, MN (US)

(72) Inventor: Harikrishna P. Natarajan, Shakopee, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/579,100

(22) Filed: Dec. 22, 2014

(65) Prior Publication Data

US 2016/0183010 A1 Jun. 23, 2016

Related U.S. Application Data

(63) Continuation of application No. 13/085,033, filed on Apr. 12, 2011, now Pat. No. 8,917,891.

(Continued)

(51) Int. Cl.
*H04R 25/00* (2006.01)

(52) U.S. Cl.
CPC ..... *H04R 25/453* (2013.01)

(58) Field of Classification Search
CPC ..... H04R 25/00

(Continued)

(56) References Cited

U.S. PATENT DOCUMENTS 3,601,549 A 8/1971 Mitchell
3,803,357 A 4/1974 Sacks (Continued)

FOREIGN PATENT DOCUMENTS

CH 653508 12/1985
DE 19748079 A1 5/1999

(Continued)

OTHER PUBLICATIONS

"U.S. Appl. No. 12/875,646, Final Office Action mailed Nov. 13, 2015", 12 pgs.

(Continued)

*Primary Examiner* — Md S Elahee
*Assistant Examiner* — Julie X Dang
(74) *Attorney, Agent, or Firm* — Schwegman, Lundberg & Woessner, P.A.

(57) ABSTRACT

Disclosed herein, among other things, are methods and apparatus for allocating feedback cancellation resources for improved acoustic feedback cancellation for hearing assistance devices. In various embodiments, a hearing assistance device includes a microphone and a processor configured to receive signals from the microphone and process them according to a plurality of processing blocks. The processor is adapted to include an event detector that can provide detection of an event and an output to adjust one or more processing blocks of the overall process to more efficiently use resources of the processor for the event detected, in various embodiments.

20 Claims, 3 Drawing Sheets

Related U.S. Application Data

(60) Provisional application No. 61/323,534, filed on Apr. 13, 2010.

(58) Field of Classification Search
USPC ..... 381/318
See application file for complete search history.

(56) References Cited

U.S. PATENT DOCUMENTS 3,995,124 A 11/1976 Gabr
4,025,721 A 5/1977 Graupe et al.
4,038,536 A 7/1977 Feintuch
4,052,559 A 10/1977 Paul et al.
4,088,834 A 5/1978 Thurmond
4,122,303 A 10/1978 Chaplin et al.
4,130,726 A 12/1978 Kates et al.
4,131,760 A 12/1978 Christensen et al.
4,176,252 A 11/1979 Dutkovich
4,185,168 A 1/1980 Graupe et al.
4,187,413 A 2/1980 Moser
4,188,667 A 2/1980 Graupe et al.
4,232,192 A 11/1980 Beex
4,238,746 A 12/1980 Chabries et al.
4,243,935 A 1/1981 McCool et al.
4,366,349 A 12/1982 Adelman
4,377,793 A 3/1983 Horna
4,425,481 A 1/1984 Mansgold et al.
4,471,171 A 9/1984 Kopke et al.
4,485,272 A 11/1984 Duong et al.
4,495,643 A 1/1985 Orban
4,508,940 A 4/1985 Steeger
4,548,082 A 10/1985 Engebretson et al.
4,582,963 A 4/1986 Danstrom
4,589,137 A 5/1986 Miller
4,596,902 A 6/1986 Gilman
4,622,440 A 11/1986 Slavin
4,628,529 A 12/1986 Borth et al.
4,630,305 A 12/1986 Borth et al.
4,658,426 A 4/1987 Chabries et al.
4,680,798 A 7/1987 Neumann
4,731,850 A 3/1988 Levitt et al.
4,751,738 A 6/1988 Widrow et al.
4,771,396 A 9/1988 South et al.
4,783,817 A 11/1988 Hamada et al.
4,783,818 A 11/1988 Graupe et al.
4,791,672 A 12/1988 Nunley et al.
4,823,382 A 4/1989 Martinez
4,879,749 A 11/1989 Levitt et al.
4,972,482 A 11/1990 Ishiguro et al.
4,972,487 A 11/1990 Mangold et al.
4,985,925 A 1/1991 Langberg et al.
4,989,251 A 1/1991 Mangold
5,016,280 A 5/1991 Engebretson et al.
5,027,410 A 6/1991 Williamson et al.
5,091,952 A 2/1992 Williamson et al.
5,170,434 A 12/1992 Anderson
5,226,086 A 7/1993 Platt
5,259,033 A 11/1993 Goodings et al.
5,276,739 A 1/1994 Krokstad et al.
5,402,496 A 3/1995 Soli et al.
5,502,869 A 4/1996 Smith et al.
5,533,120 A 7/1996 Staudacher
5,604,812 A 2/1997 Meyer
5,606,620 A 2/1997 Weinfurtner
5,619,580 A 4/1997 Hansen
5,621,802 A 4/1997 Harjani et al.
5,659,622 A 8/1997 Ashley
5,668,747 A 9/1997 Ohashi
5,706,352 A 1/1998 Engebretson et al.
5,724,433 A 3/1998 Engebretson et al.
5,737,410 A 4/1998 Vahatalo et al.
5,838,806 A 11/1998 Sigwanz et al.
5,920,548 A 7/1999 El Malki
5,987,146 A 11/1999 Pluvinage et al.
5,991,419 A 11/1999 Brander
6,035,050 A 3/2000 Weinfurtner et al.
6,044,183 A 3/2000 Pryor
6,072,884 A 6/2000 Kates
6,104,993 A 8/2000 Ashley
6,173,063 B1 1/2001 Melanson
6,219,427 B1 4/2001 Kates et al.
6,240,192 B1 5/2001 Brennan et al.
6,275,596 B1 8/2001 Fretz et al.
6,356,606 B1 3/2002 Hahm
6,389,440 B1 5/2002 Lewis et al.
6,434,246 B1 8/2002 Kates et al.
6,434,247 B1 8/2002 Kates et al.
6,480,610 B1 11/2002 Fang et al.
6,494,247 B1 12/2002 Pedone
6,498,858 B2 12/2002 Kates
6,552,446 B1 4/2003 Lomba et al.
6,563,931 B1 5/2003 Soli et al.
6,718,301 B1 4/2004 Woods
6,754,356 B1 6/2004 Luo et al.
6,831,986 B2 12/2004 Kates
6,876,751 B1 4/2005 Gao et al.
6,882,736 B2 4/2005 Dickel et al.
6,885,752 B1 4/2005 Chabries et al.
6,912,289 B2 6/2005 Vonlanthen et al.
6,928,160 B2 8/2005 Ebenezer et al.
6,999,826 B1 2/2006 Zhou et al.
7,006,646 B1 2/2006 Baechler
7,058,182 B2 6/2006 Kates
7,065,486 B1 6/2006 Thyssen
7,068,802 B2 6/2006 Schulz et al.
7,088,835 B1 8/2006 Norris et al.
7,155,018 B1 12/2006 Stokes, III et al.
7,242,777 B2 7/2007 Leenen et al.
7,283,638 B2 10/2007 Troelsen et al.
7,283,842 B2 10/2007 Berg
7,292,699 B2 11/2007 Gao et al.
7,349,549 B2 3/2008 Bachler et al.
7,386,142 B2 6/2008 Kindred
7,428,312 B2 9/2008 Meier et al.
7,519,193 B2 4/2009 Fretz
7,809,150 B2 10/2010 Natarajan et al.
7,889,879 B2 2/2011 Dillon et al.
7,945,066 B2 5/2011 Kindred
7,986,790 B2 7/2011 Zhang et al.
7,995,780 B2 8/2011 Pedersen et al.
8,116,473 B2 2/2012 Salvetti et al.
8,199,948 B2 6/2012 Theverapperuma
8,452,034 B2 5/2013 Theverapperuma
8,509,465 B2 8/2013 Theverapperuma et al.
8,553,899 B2 10/2013 Salvetti et al.
8,571,244 B2 10/2013 Salvetti
8,634,576 B2 1/2014 Salvetti et al.
8,638,949 B2 1/2014 Zhang et al.
8,681,999 B2 3/2014 Theverapperuma et al.
8,744,104 B2 6/2014 Theverapperuma
8,917,891 B2 12/2014 Natarajan
8,929,565 B2 1/2015 Salvetti et al.
8,942,398 B2 1/2015 Salvetti et al.
9,392,379 B2 7/2016 Salvetti et al.
2001/0002930 A1 6/2001 Kates
2001/0055404 A1 12/2001 Bisgaard
2002/0012438 A1 1/2002 Leysieffer et al.
2002/0025055 A1 2/2002 Stonikas et al.
2002/0039426 A1 4/2002 Takemoto et al.
2002/0051546 A1 5/2002 Bizjak
2002/0057814 A1 5/2002 Kaulberg
2002/0176584 A1 11/2002 Kates
2003/0007647 A1 1/2003 Nielsen et al.
2003/0026442 A1 2/2003 Fang et al.
2003/0031314 A1 2/2003 Tanrikulu et al.
2003/0112988 A1 6/2003 Naylor
2003/0185411 A1 10/2003 Atlas et al.
2004/0066944 A1 4/2004 Leenen et al.
2004/0086137 A1 5/2004 Yu et al.
2004/0125973 A1 7/2004 Fang et al.
2004/0136557 A1 7/2004 Kaulberg
2004/0190739 A1 9/2004 Bachler et al.
2004/0202340 A1 10/2004 Armstrong et al.
2004/0218772 A1 11/2004 Ryan

(56) References Cited

U.S. PATENT DOCUMENTS

| | | | | |
|---|---|---|---|---|
| 2005/0036632 | A1 | 2/2005 | Natarajan et al. | |
| 2005/0047620 | A1 | 3/2005 | Fretz | |
| 2005/0069162 | A1 | 3/2005 | Haykin et al. | |
| 2005/0111683 | A1 | 5/2005 | Chabries et al. | |
| 2005/0129262 | A1 | 6/2005 | Dillon et al. | |
| 2005/0265568 | A1 | 12/2005 | Kindred | |
| 2005/0283263 | A1 | 12/2005 | Eaton et al. | |
| 2006/0140429 | A1 | 6/2006 | Klinkby et al. | |
| 2006/0173259 | A1 | 8/2006 | Flaherty et al. | |
| 2006/0215860 | A1 | 9/2006 | Wyrsch | |
| 2006/0222194 | A1 | 10/2006 | Bramslow | |
| 2006/0227987 | A1 | 10/2006 | Hasler | |
| 2007/0009123 | A1 | 1/2007 | Aschoff et al. | |
| 2007/0019817 | A1 | 1/2007 | Siltmann | |
| 2007/0036280 | A1 | 2/2007 | Roeck et al. | |
| 2007/0116308 | A1 | 5/2007 | Zurek et al. | |
| 2007/0117510 | A1 | 5/2007 | Elixmann | |
| 2007/0135862 | A1 | 6/2007 | Nicolai et al. | |
| 2007/0217620 | A1 | 9/2007 | Zhang et al. | |
| 2007/0217629 | A1 | 9/2007 | Zhang et al. | |
| 2007/0219784 | A1 | 9/2007 | Zhang et al. | |
| 2007/0223755 | A1 | 9/2007 | Salvetti et al. | |
| 2007/0237346 | A1 | 10/2007 | Fichtl et al. | |
| 2007/0269065 | A1 | 11/2007 | Kilsgaard | |
| 2007/0276285 | A1 | 11/2007 | Burrows et al. | |
| 2007/0280487 | A1 | 12/2007 | Ura et al. | |
| 2008/0019547 | A1 | 1/2008 | Baechler | |
| 2008/0037798 | A1 | 2/2008 | Baechler et al. | |
| 2008/0063228 | A1 | 3/2008 | Mejia et al. | |
| 2008/0095388 | A1 | 4/2008 | Theverapperuma | |
| 2008/0095389 | A1 | 4/2008 | Theverapperuma | |
| 2008/0107296 | A1 | 5/2008 | Bachler et al. | |
| 2008/0130926 | A1 | 6/2008 | Theverapperuma | |
| 2008/0130927 | A1 | 6/2008 | Theverapperuma et al. | |
| 2008/0260190 | A1 | 10/2008 | Kidmose | |
| 2008/0304684 | A1 | 12/2008 | Kindred | |
| 2009/0154741 | A1 | 6/2009 | Woods et al. | |
| 2009/0175474 | A1 | 7/2009 | Salvetti et al. | |
| 2009/0245552 | A1 | 10/2009 | Salvetti | |
| 2010/0111339 | A1* | 5/2010 | Sira | H04R 25/453 381/318 |
| 2011/0091049 | A1 | 4/2011 | Salvetti et al. | |
| 2011/0116667 | A1 | 5/2011 | Natarajan et al. | |
| 2011/0150231 | A1 | 6/2011 | Natarajan | |
| 2011/0249846 | A1* | 10/2011 | Natarajan | H04R 25/453 381/318 |
| 2011/0249847 | A1 | 10/2011 | Salvetti et al. | |
| 2012/0155664 | A1 | 6/2012 | Zhang et al. | |
| 2012/0230503 | A1 | 9/2012 | Theverapperuma | |
| 2014/0098967 | A1 | 4/2014 | Salvetti et al. | |
| 2014/0348361 | A1 | 11/2014 | Theverapperuma et al. | |
| 2015/0110317 | A1 | 4/2015 | Salvetti et al. | |

FOREIGN PATENT DOCUMENTS

| | | | |
|---|---|---|---|
| DK | 1835708 | T3 | 8/2013 |
| EP | 250679 | A2 | 1/1988 |
| EP | 0396831 | A2 | 11/1990 |
| EP | 250679 | B1 | 7/1993 |
| EP | 0585976 | A2 | 3/1994 |
| EP | 0335542 | B1 | 12/1994 |
| EP | 712263 | A1 | 5/1996 |
| EP | 712263 | B1 | 1/2003 |
| EP | 1367857 | A1 | 12/2003 |
| EP | 1256258 | B1 | 3/2005 |
| EP | 1538868 | A2 | 6/2005 |
| EP | 1624719 | A2 | 2/2006 |
| EP | 1718110 | A1 | 2/2006 |
| EP | 1708543 | A1 | 10/2006 |
| EP | 1835784 | A1 | 9/2007 |
| EP | 2003928 | A1 | 12/2008 |
| EP | 2080408 | B1 | 8/2012 |
| EP | 2106163 | B1 | 3/2013 |
| EP | 1835708 | B1 | 5/2013 |
| GB | 1356645 | | 6/1974 |
| JP | 59-64994 | | 4/1984 |
| JP | 60-31315 | | 2/1985 |
| WO | WO-0106746 | A2 | 1/2001 |
| WO | WO-0106812 | A1 | 1/2001 |
| WO | WO-0110170 | A2 | 2/2001 |
| WO | WO-0154456 | A1 | 7/2001 |
| WO | WO-03045108 | A2 | 5/2003 |
| WO | WO-03098970 | A1 | 11/2003 |
| WO | WO-2004105430 | A1 | 12/2004 |
| WO | WO-2005002433 | A1 | 1/2005 |
| WO | WO-2005018275 | A2 | 2/2005 |
| WO | WO-2007020299 | A2 | 2/2007 |
| WO | WO-2007045276 | A1 | 4/2007 |
| WO | WO-2007112737 | A1 | 10/2007 |
| WO | WO-2008051569 | A2 | 5/2008 |
| WO | WO-2008051569 | A3 | 5/2008 |
| WO | WO-2008051570 | A1 | 5/2008 |
| WO | WO-2008051571 | A1 | 5/2008 |
| WO | WO-2009068028 | A1 | 6/2009 |
| WO | WO-2009124550 | A1 | 10/2009 |

OTHER PUBLICATIONS

"U.S. Appl. No. 12/644,932, Non Final Office Action mailed Jan. 5, 2016", 29 pgs.
"U.S. Appl. No. 12/875,646, Advisory Action mailed Feb. 18, 2016", 4 pgs.
"U.S. Appl. No. 12/875,646, Response filed Jan. 13, 2016 to Final Office Action mailed Nov. 13, 2015", 9 pgs.
"U.S. Appl. No. 14/589,275, Response filed Jan. 26, 2016 to Non Final Office Action mailed Oct. 26, 2015", 8 pgs.
"U.S. Appl. No. 10/857,599, Examiner Interview Summary Jul. 16, 2010", (Jul. 16, 2010), 1 pgs.
"U.S. Appl. No. 11/276,793, Non Final Office Action mailed May 12, 2009", 20 pgs.
"U.S. Appl. No. 11/276,793, Response filed Nov. 11, 2009 to Non Final Office Action mailed May 12, 2009", 16 pgs.
"U.S. Appl. No. 11/276,795, Advisory Action mailed Jan. 12, 2010", 13 pgs.
"U.S. Appl. No. 11/276,795, Decision on Pre-Appeal Brief Request mailed Apr. 14, 2010", 2 pgs.
"U.S. Appl. No. 11/276,795, Examiner Interview Summary mailed Feb. 9, 2011", 3 pgs.
"U.S. Appl. No. 11/276,795, Examiner Interview Summary mailed Mar. 11, 2011", 1 pg.
"U.S. Appl. No. 11/276,795, Final Office Action mailed Oct. 14, 2009", 15 pgs.
"U.S. Appl. No. 11/276,795, Final Office Action mailed Nov. 24, 2010", 17 pgs.
"U.S. Appl. No. 11/276,795, Non Final Office Action mailed May 7, 2009", 13 pgs.
"U.S. Appl. No. 11/276,795, Non Final Office Action mailed May 27, 2010", 14 pgs.
"U.S. Appl. No. 11/276,795, Notice of Allowance mailed Mar. 18, 2011", 12 pgs.
"U.S. Appl. No. 11/276,795, Pre-Appeal Brief Request mailed Feb. 16, 2010", 4 pgs.
"U.S. Appl. No. 11/276,795, Response filed Jan. 24, 2011 to Final Office Action mailed Nov. 24, 2010", 11 pgs.
"U.S. Appl. No. 11/276,795, Response filed Sep. 8, 2009 to Non Final Office Action mailed May 7, 2009", 10 pgs.
"U.S. Appl. No. 11/276,795, Response filed Sep. 28, 2010 to Non Final Office Action mailed May 27, 2010", 6 pgs.
"U.S. Appl. No. 11/276,795, Response filed Dec. 14, 2009 to Final Office Action mailed Oct. 14, 2009", 10 pgs.
"U.S. Appl. No. 11/877,317, Examiner Interview Summary mailed Jun. 1, 2012", (Jun. 1, 2012), 1 pgs.
"U.S. Appl. No. 11/877,317, Non Final Office Action mailed Aug. 18, 2011", 16 pgs.
"U.S. Appl. No. 11/877,317, Notice of Allowance mailed Jan. 31, 2013", 8 pgs.
"U.S. Appl. No. 11/877,317, Notice of Allowance mailed Jun. 1, 2012", 12 pgs.

(56) References Cited

OTHER PUBLICATIONS

"U.S. Appl. No. 11/877,317, Notice of Allowance mailed Sep. 17, 2012", 8 pgs.
"U.S. Appl. No. 11/877,317, Response filed Feb. 20, 2012 to Non Final Office Action mailed Aug. 18, 2011", 9 pgs.
"U.S. Appl. No. 11/877,567, Examiner Interview Summary mailed May 31, 2012", (May 31, 2012), 1 pgs.
"U.S. Appl. No. 11/877,567, Non Final Office Action mailed Sep. 1, 2011", 17 pgs.
"U.S. Appl. No. 11/877,567, Notice of Allowance mailed Apr. 12, 2013", 9 pgs.
"U.S. Appl. No. 11/877,567, Notice of Allowance mailed May 31, 2012", 11 pgs.
"U.S. Appl. No. 11/877,567, Notice of Allowance mailed Sep. 28, 2012", 8 pgs.
"U.S. Appl. No. 11/877,567, Notice of Allowance mailed Nov. 14, 2013", 10 pgs.
"U.S. Appl. No. 11/877,567, Response filed Mar. 1, 2012 to Non Final Office Action mailed Sep. 1, 2011", 11 pgs.
"U.S. Appl. No. 11/877,605, Examiner Interview Summary mailed Apr. 10, 2013", (Apr. 10, 2013), 1 pgs.
"U.S. Appl. No. 11/877,605, Final Office Action mailed Apr. 9, 2012", 17 pgs.
"U.S. Appl. No. 11/877,605, Non Final Office Action mailed Sep. 27, 2011", 12 pgs.
"U.S. Appl. No. 11/877,605, Non Final Office Action mailed Nov. 20, 2012", 8 pgs.
"U.S. Appl. No. 11/877,605, Notice of Allowance mailed Apr. 10, 2013", 11 pgs.
"U.S. Appl. No. 11/877,605, Response filed Jan. 27, 2012 to Non Final Office Action mailed Sep. 27, 2011", 10 pgs.
"U.S. Appl. No. 11/877,605, Response filed Mar. 20, 2013 to Non Final Office Action mailed Nov. 20, 2013", 8 pgs.
"U.S. Appl. No. 11/877,605, Response filed Jul. 9, 2012 to Final Office Action mailed Apr. 9, 2012", 9 pgs.
"U.S. Appl. No. 11/877,606, Examiner Interview Summary mailed Feb. 8, 2012", 1 pg.
"U.S. Appl. No. 11/877,606, Final Office Action mailed Dec. 2, 2011", 11 pgs.
"U.S. Appl. No. 11/877,606, Non Final Office Action mailed Jun. 10, 2011", 12 pgs.
"U.S. Appl. No. 11/877,606, Notice of Allowance mailed Feb. 15, 2012", 10 pgs.
"U.S. Appl. No. 11/877,606, Response filed Feb. 2, 2012 to Final Office Action mailed Dec. 2, 2011", 9 pgs.
"U.S. Appl. No. 11/877,606, Response filed Sep. 12, 2011 to Non-Final Office Action mailed Jun. 10, 2011", 7 pgs.
"U.S. Appl. No. 12/644,932, Advisory Action mailed Jun. 17, 2015", 3 pgs.
"U.S. Appl. No. 12/644,932, Final Office Action mailed Apr. 3, 2015", 28 pgs.
"U.S. Appl. No. 12/644,932, Response filed Feb. 9, 2015 to Non Final Office Action mailed Oct. 8, 2014", 11 pgs.
"U.S. Appl. No. 12/644,932, Response filed Jun. 3, 2015 to Final Office Action mailed Apr. 3, 2015", 11 pgs.
"U.S. Appl. No. 12/875,646, Advisory Action mailed Mar. 2, 2015", 2 pgs.
"U.S. Appl. No. 12/875,646, Non Final Office Action mailed Jul. 17, 2015", 11 pgs.
"U.S. Appl. No. 12/875,646, Response filed Jan. 26, 2015 to Final Office Action mailed Oct. 24, 2014", 8 pgs.
"U.S. Appl. No. 12/875,646, Response filed Oct. 19, 2015 to Non Final Office Action mailed Jul. 17, 2015", 8 pgs.
"U.S. Appl. No. 13/189,990, Advisory Action mailed Aug. 1, 2013", 3 pgs.
"U.S. Appl. No. 13/189,990, Examiner Interview Summary mailed Sep. 18, 2013", 1 pgs.
"U.S. Appl. No. 13/189,990, Final Office Action mailed May 22, 2013", 15 pgs.
"U.S. Appl. No. 13/189,990, Non Final Office Action mailed Nov. 26, 2012", 12 pgs.
"U.S. Appl. No. 13/189,990, Notice of Allowance mailed Sep. 18, 2013", 15 pgs.
"U.S. Appl. No. 13/189,990, Preliminary Amendment filed Mar. 5, 2012", 37 pgs.
"U.S. Appl. No. 13/189,990, Response filed Feb. 27, 2013 to Non Final Office Action mailed Nov. 26, 2012", 8 pgs.
"U.S. Appl. No. 13/189,990, Response filed Jul. 22, 2013 to Final Office Action mailed May 22, 13", 8 pgs.
"U.S. Appl. No. 13/478,570, Non Final Office Action mailed Aug. 13, 2013", 7 pgs.
"U.S. Appl. No. 13/478,570, Notice of Allowance mailed Jan. 21, 2014", 5 pgs.
"U.S. Appl. No. 13/478,570, Response filed Nov. 13, 2013 to Non Final Office Action mailed Aug. 13, 2013", 10 pgs.
"U.S. Appl. No. 14/223,669, Non Final Office Action mailed Nov. 21, 2014", 24 pgs.
"U.S. Appl. No. 14/589,275, Non Final Office Action mailed Oct. 26, 2015", 10 pgs.
"U.S. Appl. No. 14/589,275, Preliminary Amendment filed Jun. 29, 2015", 6 pgs.
"European Application Serial No. 07839766.8, Office Action mailed Jun. 8, 2009", 2 pgs.
"European Application Serial No. 07839766.8, Office Action mailed Jul. 2, 2009", 2 pgs.
"European Application Serial No. 07839766.8, Office Action mailed Sep. 17, 2012", 10 pgs.
"European Application Serial No. 07250899.7, response filed Sep. 5, 2011 to Office Action mailed Mar. 21, 2011", 25 pgs.
"European Application Serial No. 07250920.1, Extended European Search Report mailed May 11, 2007", 6 pgs.
"European Application Serial No. 07839766.8, Response filed Jan. 11, 2013 to Office Action mailed Sep. 17, 2012", 16 pgs.
"European Application Serial No. 07839767.6, Office Action mailed Mar. 8, 2012", 27 pgs.
"European Application Serial No. 07839767.6, Amendment filed Jun. 2, 2011", 11 pgs.
"European Application Serial No. 07839767.6, Decision to Grant mailed Jul. 19, 2012", 2 pgs.
"European Application Serial No. 07839767.6, Office Action mailed May 5, 2011", 4 pgs.
"European Application Serial No. 07839768.4, Examination Notification Art. 94(3) mailed Feb. 26, 2014", 6 pgs.
"European Application Serial No. 07839768.4, Office Action mailed Dec. 9, 2011", 3 pgs.
"European Application Serial No. 07839768.4, Response filed Apr. 5, 2012 to Office Action mailed Dec. 9, 2011", 20 pgs.
"European Application Serial No. 07839768.4, Response filed Jun. 20, 2014 to Office Action mailed Feb. 26, 2014", (Jul. 20, 2014), 10 pgs.
"European Application Serial No. 08253924.8, Search Report mailed Jul. 1, 2009", 8 pgs.
"European Application Serial No. 09250817.5, Amendment filed Jun. 22, 2011", 25 pgs.
"European Application Serial No. 10252109.3, Amendment filed Jul. 16, 2013", 18 pgs.
"European Application Serial No. 10252109.3, Extended Search Report mailed Dec. 18, 2012", 8 pgs.
"European Application Serial No. 10252109.3, Office Action mailed Jan. 21, 2013", 2 pgs.
"International Application Serial No. PCT/US2007/022548, International Preliminary Report on Patentability mailed May 7, 2009", 8 pgs.
"International Application Serial No. PCT/US2007/022548, Search Report mailed Jun. 3, 2008", 7 pgs.
"International Application Serial No. PCT/US2007/022548, Written Opinion mailed Jun. 3, 2008", 8 pgs.
"International Application Serial No. PCT/US2007/022549, International Preliminary Report on Patentability mailed May 7, 2009", 8 pgs.

(56) References Cited

OTHER PUBLICATIONS

"International Application Serial No. PCT/US2007/022549, International Search Report and Written Opinion mailed Feb. 15, 2008", 12 pgs.
"International Application Serial No. PCT/US2007/022550, International Preliminary Report on Patentability mailed May 7, 2009", 8 pgs.
"International Application Serial No. PCT/US2007/022550, International Search Report and Written Opinion mailed Oct. 23, 2006", 12 pgs.
Beaufays, Francoise, "Transform-Domain Adaptive Filters: An Analytical Approach", IEEE Trans. on Signal Proc., vol. 43(2), (Feb. 1995), 422-431.
Chankawee, A., et al., "Performance improvement of acoustic feedback cancellation in hearing aids using liner prediction", Digital Signal Processing Research Laboratory(DSPRL), (Nov. 21, 2004), 116-119.
Haykin, Simon, "Adaptive Filter Theory: 3rd Edition", Prentice Hall, (1996), 3 pgs.
Haykin, Simon, "Adaptive Filter Theory: Third Edition: Appendix G Gradient Adaptive Lattice Algorithm", Prentice Hall, (1996), 5 pgs.
Jenkins, W. Kenneth, et al., "Chapter 22—Transform Domain Adaptive Filtering", The Digital Signal Processing Handbook, Editors, Vijay K. Madisetti, Douglas B. Williams; Boca Raton, FL:CRC Press, (1998), 22-1-22-20.
Mueller, Gustav H, "Data logging: It's popular, but how can this feature be used to help patients?", The Hearing Journal vol. 60, No. 10,, XP002528491, (Oct. 2007), 6 pgs.
Mueller, H. Gustav, "Data logging: It's popular, but how can this feature be used to help patients?", Hearing Journal, 60(10), (Oct. 1, 2007), 6 pgs.
Preves, David A., "Field Trial Evaluations of a Switched Directional/Omnidirectional In-the-Ear Hearing Instrument", Journal of the American Academy of Audiology, 10(5), (May 1999), 273-283.
Proakis, J. G, et al., "Digital Signal Processing", Prentice-Hall, Inc., XP002481168, (1996), 5 pgs.
Spreiet, Ann, et al., "Adaptive Feedback Cancellation in Hearing Aids With Linear Prediction of the Desired Signal", IEEE Transactions on Signal Processing 53(10), (Oct. 2005), 3749-3763.
Theverapperuma, Lalin S, et al., "Adaptive Feedback Canceller: Entrainment", Digital Signal Processing Workshop, 4th IEEE, PI, (Sep. 1, 2006), 245-250.
Theverapperuma, Lalin S, et al., "Continuous Adaptive Feedback Canceller Dynamics", Circuits and Systems, MWSCAS 2006. 49th IEEE International Midwest Symposium on Circuits and Systems, (Aug. 1, 2006), 605-609.
Theverapperurna, Lalin S, et al., "Adaptive Feedback Canceller: Entrainment", Digital Signal Processing Workshop, 12th—Signal Processing Education Workshop, 4th, IEEE, (2006), 245-250.
Wong, T.W., et al., "Adaptive Filtering Using Hartley Transform and Overlap-Saved method", IEEE Transaction on Signal Processing, vol. 39, No. 7, (Jul. 1991), 1708-1711.
"Advance Adaptive Feedback Cancellation", IntriCon: Technology White Paper, [Online]. Retrieved from the Internet: <URL: http://www.intricondownloads.com/D1/techdemo/WP_Advanced_AFC_rev101006.pdf>, (Oct. 10, 2005), 3 pgs.
"U.S. Appl. No. 10/854,922, Non Final Office Action mailed Sep. 5, 2006", 13 pgs.
"U.S. Appl. No. 10/854,922, Notice of Allowance mailed May 22, 2007", 7 pgs.
"U.S. Appl. No. 10/854,922, Notice of Allowance mailed Nov. 19, 2007", 9 pgs.
"U.S. Appl. No. 10/854,922, Response filed Mar. 5, 2007 to Non Final Office Action mailed Sep. 5, 2006", 12 pgs.
"U.S. Appl. No. 10/857,599, Final Office Action mailed Jun. 11, 2009", 7 pgs.
"U.S. Appl. No. 10/857,599, Final Office Action Mailed Jul. 24, 2008", 9 pgs.
"U.S. Appl. No. 10/857,599, Non-Final Office Action mailed Jan. 26, 2010", 8 pgs.
"U.S. Appl. No. 10/857,599, Non-Final Office Action mailed Dec. 26, 2007", 8 pgs.
"U.S. Appl. No. 10/857,599, Non-Final Office Action mailed Dec. 31, 2008", 6 pgs.
"U.S. Appl. No. 10/857,599, Notice of Allowance mailed Jul. 26, 2010", 10 pgs.
"U.S. Appl. No. 10/857,599, Response filed Apr. 26, 2010 to Non Final Office Action mailed Jan. 26, 2010", 8 pgs.
"U.S. Appl. No. 10/857,599, Response filed Apr. 28, 2008 to Non-Final Office Action mailed Dec. 26, 2007", 7 pgs.
"U.S. Appl. No. 10/857,599, Response Apr. 30, 2009 to Non-Final Office Action mailed Dec. 31, 2008", 7 pgs.
"U.S. Appl. No. 10/857,599, Response filed Nov. 12, 2009 to Final Office Action mailed Jun. 11, 2009", 9 pgs.
"U.S. Appl. No. 10/857,599, Response filed Nov. 16, 2007 to Restriction Requirement mailed May 21, 2007", 6 pgs.
"U.S. Appl. No. 10/857,599, Response filed Nov. 24, 2008 to Final Office Action mailed Jul. 24, 2008", 9 pgs.
"U.S. Appl. No. 10/857,599, Restriction Requirement mailed May 21, 2007", 5 pgs.
"U.S. Appl. No. 11/276,763, Decision on Pre-Appeal Brief Request mailed Feb. 15, 2011", 3 pgs.
"U.S. Appl. No. 11/276,763, Final Office Action mailed Sep. 14, 2010", 9 pgs.
"U.S. Appl. No. 11/276,763, Non-Final Office Action mailed Apr. 2, 2010", 11 pgs.
"U.S. Appl. No. 11/276,763, Notice of Allowance mailed Aug. 25, 2011", 8 pgs.
"U.S. Appl. No. 11/276,763, Notice of Allowance mailed Oct. 11, 2011", 8 pgs.
"U.S. Appl. No. 11/276,763, Pre-Appeal Brief Request filed Jan. 14, 2011", 5 pgs.
"U.S. Appl. No. 11/276,763, Response filed Jan. 11, 2010 to Restriction Requirement mailed Dec. 10, 2009", 9 pgs.
"U.S. Appl. No. 11/276,763, Response filed Jun. 15, 2011 to Final Office Action mailed Sep. 14, 2010 and Decision on Pre-Appeal Brief mailed Feb. 15, 2011", 10 pgs.
"U.S. Appl. No. 11/276,763, Response filed Jul. 2, 2010 to Non Final Office Action mailed Apr. 2, 2010", 15 pgs.
"U.S. Appl. No. 11/276,763, Restriction Requirement mailed Dec. 10, 2009", 6 pgs.
"U.S. Appl. No. 12/135,856 Non-Final Office Action mailed Sep. 23, 2010", 8 Pgs.
"U.S. Appl. No. 12/135,856, Notice of Allowance mailed Mar. 11, 2011", 9 pgs.
"U.S. Appl. No. 12/135,856, Response filed Dec. 23, 2010 to Non Final Office Action mailed Sep. 23, 2010", 10 pgs.
"U.S. Appl. No. 12/336,460, Advisory Action mailed Jul. 30, 2012", 3 pgs.
"U.S. Appl. No. 12/336,460, Final Office Action mailed Apr. 27, 2012", 8 pgs.
"U.S. Appl. No. 12/336,460, Non Final Office Action mailed Sep. 29, 2011", 13 pgs.
"U.S. Appl. No. 12/336,460, Non Final Office Action mailed Nov. 26, 2012", 6 pgs.
"U.S. Appl. No. 12/336,460, Notice of Allowance mailed May 10, 2013", 9 pgs.
"U.S. Appl. No. 12/336,460, Response filed Jan. 30, 2012 to Non Final Office Action mailed Sep. 29, 2011", 25 pgs.
"U.S. Appl. No. 12/336,460, Response filed Apr. 26, 2013 to Non final Office Action mailed Nov. 26, 2012", 8 pgs.
"U.S. Appl. No. 12/336,460, Response filed Jun. 27, 2012 to Final Office Action mailed Apr. 27, 2012", 10 pgs.
"U.S. Appl. No. 12/336,460, Supplemental Notice of Allowability mailed Sep. 13, 2013", 2 pgs.
"U.S. Appl. No. 12/408,928, Non Final Office Action mailed Aug. 4, 2011", 25 pgs.
"U.S. Appl. No. 12/408,928, Notice of Allowance mailed May 11, 2012", 9 pgs.
"U.S. Appl. No. 12/408,928, Notice of Allowance mailed Jun. 24, 2013", 10 pgs.

(56) References Cited

OTHER PUBLICATIONS

"U.S. Appl. No. 12/408,928, Preliminary Amendment filed Jun. 22, 2011", 11 pgs.
"U.S. Appl. No. 12/408,928, Preliminary Amendment mailed Jun. 24, 2009", 3 pgs.
"U.S. Appl. No. 12/408,928, Response filed Feb. 6, 2012 to Non Final Office Action mailed Aug. 4, 2011", 23 pgs.
"U.S. Appl. No. 12/644,932, Final Office Action mailed Mar. 18, 2013", 24 pgs.
"U.S. Appl. No. 12/644,932, Non Final Office Action mailed Oct. 8, 2014", 27 pgs.
"U.S. Appl. No. 12/644,932, Non Final Office Action mailed Dec. 29, 2011", 14 pgs.
"U.S. Appl. No. 12/644,932, Response filed Jun. 28, 2012 to Non Final Office Action mailed Dec. 29, 2011", 12 pgs.
"U.S. Appl. No. 12/644,932, Response filed Sep. 13, 2013 to Final Office Action mailed Mar. 18, 2013", 12 pgs.
"U.S. Appl. No. 12/875,646, Advisory Action mailed May 19, 2014", 3 pgs.
"U.S. Appl. No. 12/875,646, Final Office Action mailed Feb. 25, 2014", 10 pgs.
"U.S. Appl. No. 12/875,646, Final Office Action mailed Oct. 24, 2014", 10 pgs.
"U.S. Appl. No. 12/875,646, Final Office Action mailed Oct. 25, 2012", 10 pgs.
"U.S. Appl. No. 12/875,646, Non Final Office Action mailed Jan. 30, 2012", 4 pgs.
"U.S. Appl. No. 12/875,646, Non Final Office Action mailed May 10, 2013", 9 pgs.
"U.S. Appl. No. 12/875,646, Non Final Office Action mailed Jun. 25, 2014", 10 pgs.
"U.S. Appl. No. 12/875,646, Response filed Apr. 25, 2013 to Final Office Action mailed Oct. 25, 2012", 9 pgs.
"U.S. Appl. No. 12/875,646, Response filed Apr. 25, 2014 to Final Office Action mailed Feb. 25, 2014", 9 pgs.
"U.S. Appl. No. 12/875,646, Response filed Jul. 30, 2012 to Non Final Office Action mailed Jan. 30, 2012", 7 pgs.
"U.S. Appl. No. 12/875,646, Response filed Sep. 25, 2014 to Non Final Office Action mailed Jun. 25, 14", 8 pgs.
"U.S. Appl. No. 12/875,646, Response filed Oct. 10, 2013 to Non Final Office Action mailed May 10, 13", 11 pgs.
"U.S. Appl. No. 12/980,720, Non Final Office Action mailed Dec. 14, 2012", 10 pgs.
"U.S. Appl. No. 12/980,720, Notice of Allowance mailed May 29, 2013", 8 pgs.
"U.S. Appl. No. 12/980,720, Notice of Allowance mailed Sep. 11, 2013", 8 pgs.
"U.S. Appl. No. 12/980,720. Response filed May 14, 2013 to Non Final Office Action mailed Dec. 14, 2013", 8 pgs.
"U.S. Appl. No. 13/085,033, Advisory Action mailed Nov. 7, 2013", 3 pgs.
"U.S. Appl. No. 13/085,033, Corrected Notice of Allowance mailed Sep. 19, 2014", 4 pgs.
"U.S. Appl. No. 13/085,033, Final Office Action mailed Aug. 26, 2013", 12 pgs.
"U.S. Appl. No. 13/085,033, Non Final Office Action mailed Mar. 6, 2014", 12 pgs.
"U.S. Appl. No. 13/085,033, Non Final Office Action mailed May 2, 2013", 10 pgs.
"U.S. Appl. No. 13/085,033, Non Final Office Action mailed Nov. 9, 2012", 9 pgs.
"U.S. Appl. No. 13/085,033, Notice of Allowance mailed Aug. 12, 2014", 9 pgs.
"U.S. Appl. No. 13/085,033, Response filed Apr. 9, 2013 to Non Final Office Action mailed Nov. 9, 2012", 8 pgs.
"U.S. Appl. No. 13/085,033, Response filed Jun. 17, 2014 to Non Final Office Action mailed Mar. 6, 2014", 9 pgs.
"U.S. Appl. No. 13/085,033, Response filed Aug. 2, 2013 to Non Final Office Action mailed May 2, 2013", 8 pgs.
"U.S. Appl. No. 13/085,033, Response filed Oct. 28, 2013 to Final Office Action mailed Aug. 26, 2013", 10 pgs.
"U.S. Appl. No. 13/085,042, Final Office Action mailed May 6, 2013", 10 pgs.
"U.S. Appl. No. 13/085,042, Non Final Office Action mailed Nov. 9, 2012", 9 pgs.
"U.S. Appl. No. 13/085,042, Notice of Allowance mailed Mar. 17, 2014", 5 pgs.
"U.S. Appl. No. 13/085,042, Notice of Allowance mailed Jul. 25, 2013", 6 pgs.
"U.S. Appl. No. 13/085,042, Notice of Allowance mailed Sep. 22, 2014", 5 pgs.
"U.S. Appl. No. 13/085,042, Response filed Apr. 9, 2013 to Non Final Office Action mailed Nov. 9, 2012", 8 pgs.
"U.S. Appl. No. 13/085,042, Response filed Jul. 8, 2013 to Final Office Action mailed May 6, 2013", 8 pgs.
"U.S. Appl. No. 14/105,269, Non Final Office Action mailed Mar. 13, 2014", 10 pgs.
"U.S. Appl. No. 14/105,269, Notice of Allowance mailed Aug. 21, 2014", 7 pgs.
"U.S. Appl. No. 14/105,269, Response Filed Jul. 14, 2014 to Non Final Office Action mailed Mar. 13, 2014", 7 pgs.
"U.S. Appl. No. 14/105,269, Supplemental Notice of Allowability mailed Sep. 15, 2014", 3 pgs.
"Entrainment (Physics)", [Online]. Retrieved from the Internet: <URL: http://en.wikipedia.org/w/index.php?title=Entrainment_(physics)&printable=yes>, (Accessed Jun. 18, 2009), 2 pgs.
"European Application Serial No. 07250899.7, Extended European Search Report mailed May 15, 2008", 7 pgs.
"European Application Serial No. 07250899.7, Office Action Mailed Jan. 15, 2009", 1 pgs.
"European Application Serial No. 07250899.7, Office Action mailed Mar. 21, 2011", 3 pgs.
"European Application Serial No. 07250899.7, Response filed Jul. 13, 2009 to Office Action mailed Jan. 15, 2009", 17 pgs.
"European Application Serial No. 09250817.5, Extended European Search Report mailed Nov. 18, 2010", 7 pgs.
"Inspiria Ultimate—GA3285", [Online]. Retrieved from the Internet: <URL: http://www.sounddesigntechnologies.com/products_InspiriaUltimate.php>, (Accessed Jun. 18, 2009), 4 pgs.
Anderson, D. B., "Noise Reduction in Speech Signals Using Pre-Whitening and the Leaky Weight Adaptive Line Enhancer", (Project Report presented to the Department of Electrical Engineering, Brigham Young University), (Feb. 1981), 56 pgs.
Best, L. C., "Digital Suppression of Acoustic Feedback in Hearing Aids", Thesis, Department of Electrical Engineering and The Graduate School of the University of Wyoming, (May 1985), 66 pgs.
Boll, Steven F., "Suppression of Acoustic Noise in Speech Using Spectral Subtraction", IEEE Transactions on Acoustics, Speech, and Signal Processing, vol. ASSP-27, (Apr. 1979), 113-120.
Bustamante, D. K., et al., "Measurement and Adaptive Suppression of Acoustic Feedback in Hearing Aids", 1989 International Conference on Acoustics, Speech, and Signal Processing, 1989. ICASSP-89., (1989), 2017-2020.
Chabries, D. M., et al., "A General Frequency-Domain LMS Adaptive Algorithm", IEEE Transactions on Acoustics, Speech, and Signal Processing, (Aug. 1984), 6 pgs.
Chazan, D., et al., "Noise Cancellation for Hearing Aids", IEEE International Conference on ICASSP '86. Acoustics, Speech, and Signal Processing,, OTI 000251-255, (Apr. 1986), 977-980.
Christiansen, R. W., "A Frequency Domain Digital Hearing Aid", 1986 IEEE ASSP Workshop on Applications of Signal Processing to Audio and Acoustics, IEEE Acoustics, Speech, and Signal Processing Society, (1986), 4 pgs.
Christiansen, R. W., et al., "Noise Reduction in Speech Using Adaptive Filtering I: Signal Processing Algorithms", Proceedings, 103rd Conference of Acoustical Society of America, (Apr. 1982), 7 pgs.
Egolf, D. P., et al., "The Hearing Aid Feedback Path: Mathematical Simulations and Experimental Verification", J. Acoust. Soc. Am., 78(5), (1985), 1576-1587.

(56) References Cited

OTHER PUBLICATIONS

Kaneda, Y., et al., "Noise suppression. signal processing using 2-point received signals", Electronics and Communications in Japan (Part I: Communications), 67-A(12), (1984), 19-28.
Levitt, H., "A Cancellation Technique for the Amplitude and Phase Calibration of Hearing Aids and Nonconventional Transducers", Journal of Rehabilitation Research, 24(4), (1987), 261-270.
Levitt, H., et al., "A Digital Master Hearing Aid", Journal of Rehabilitation Research and Development, 23(1), (1986), 79-87.
Levitt, H., et al., "A Historical Perspective on Digital Hearing Aids: How Digital Technology Has Changed Modern Hearing Aids", Trends in Amplification, 11(1), (Mar. 2007), 7-24.
Levitt, H., "Technology and the Education of the Hearing Impaired", Chapt. 6: Education of the Hearing Impaired Child, College-Hill Press, (Mar. 1985).
Maxwell, J. A., et al., "Reducing Acoustic Feedback in Hearing Aids", IEEE Transactions on Speech and Audio Processing, 3(4), (Jul. 1995), 304-313.
McAulay, R., et al., "Speech enhancement using a soft-decision noise suppression filter", IEEE Transactions on Acoustics, Speech, and Signal Processing [see also IEEE Transactions on Signal Processing], 28(2), (Apr. 1980), 137-145.
Paul, Embree, "C algorithms for real-time DSP", Library of Congress Cataloging-In-Publication Data, Prentice Hall PTR, (1995), 98-113, 134-137, 228-233, 147.
Paul, Embree, "C++ Algorithms for Digital Signal Processing", Prentice Hall PTR, (1999), 313-320.
Preves, D. A., "Evaluation of Phase Compensation for Enhancing the Signal Processing Capabilities of Hearing Aids in Situ", Thesis, Graduate School of the University of Minnesota, (Oct. 1985), 203 pgs.
Rife, D., et al., "Transfer-Function Measurement With Maximum-Length Sequences", J. Audio Eng. Soc., 37(6), (1989), 419-444.
Rosenberger, J. R., et al., "Performance of an Adaptive Echo Canceller Operating in a Noisy, Linear, Time-Invariant Environment", The Bell System Technical Journal, 50(3), (1971), 785-813.
Saeed, V. Vaseghi, "Echo Cancellation", Advanced Digital Signal Processing and Noise Reduction, Second Edition., John Wiley & Sons, (2000), 397-404.
South, C. R., et al., "Adaptive Filters to Improve Loudspeaker Telephone", Electronics Letters,15(21), (1979), 673-674.
Taylor, Jennifer Suzanne, "Subjective versus objective measures of daily listening environments", Independent Studies and Capstones. Paper 492. Program in Audiology and Communication Sciences, Washington University School of Medicine., http://digitalcommons.wustl.edu/pacs_capstones/492, (2007), 50 pgs.
Weaver, K. A., "An Adaptive Open-Loop Estimator for the Reduction of Acoustic Feedback", Thesis, Department of Electrical Engineering and The Graduate School of the University of Wyoming, (Dec. 1984), 70 pgs.
Weaver, K. A., et al., "Electronic Cancellation of Acoustic Feedback to Increase Hearing-Aid Stability", The Journal of the Acoustical Society of America, vol. 77, Issue S1, 109th Meeting, Acoustical Society of America, (Apr. 1985), p. S105.
Widrow, B, et al., "Stationary and nonstationary learning characteristics of the LMS adaptive filter", Proceedings of the IEEE, 64(8), (Aug. 1976), 1151-1162.
Widrow, B., et al., "Adaptive Antenna Systems", Proceedings of the IEEE, 55(12), (Dec. 1967), 2143-2159.
Widrow, B., et al., "Adaptive Noise Cancelling: Principles and Applications", Proceedings of the IEEE, 63(12), (1975), 1692-1716.
Wreschner, M. S., et al., "A Microprocessor Based System for Adaptive Hearing Aids", 1985 ASEE Annual Conference Proceedings, (1985), 688-691.
"U.S. Appl. No. 12/644,932, Final Office Action mailed Jul. 8, 2016", 32 pgs.
"U.S. Appl. No. 12/644,932, Response filed Apr. 5, 2016 to Non Final Office Action mailed Jan. 5, 2016", 11 pgs.
"U.S. Appl. No. 12/875,646, Non Final Office Action mailed Jun. 2, 2016", 12 pgs.
"U.S. Appl. No. 14/589,275 , Notice of Allowance mailed Mar. 11, 2016", 7 pgs.
"U.S. Appl. No. 12/644,932, Advisory Action mailed Sep. 28, 16", 4 pgs.
"U.S. Appl. No. 12/644,932, Non Final Office Action mailed Nov. 18, 2016", 7 pgs.
"U.S. Appl. No. 12/644,932, Response filed Sep. 8, 2016 to Final Office Action mailed Jul. 8, 2016", 10 pgs.

* cited by examiner

METHODS AND APPARATUS FOR ALLOCATING FEEDBACK CANCELLATION RESOURCES FOR HEARING ASSISTANCE DEVICES

CLAIM OF PRIORITY

This application is a continuation of and claims the benefit of priority to U.S. patent application Ser. No. 13/085,033, filed on 12 Apr. 2011, now issued as U.S. Pat. No. 8,917,891, which application claims the benefit under 35 U.S.C. 119(e) of U.S. Provisional Application Ser. No. 61/323,534, filed Apr. 13, 2010, which applications are incorporated herein by reference in their entirety.

FIELD OF THE INVENTION

The present subject matter relates generally to signal processing for hearing assistance devices and in particular to methods and apparatus for allocating feedback cancellation resources for hearing assistance devices.

BACKGROUND

Modern hearing assistance devices, such as hearing aids, typically include a digital signal processor in communication with a microphone and receiver. Such designs are adapted to perform a great deal of processing on sounds received by the microphone. These designs can be highly programmable and may use specialized signal processing techniques for acoustic feedback cancellation and a host of other signal processing activities.

Signal processing approaches can use a substantial amount of the available signal processing capabilities of a digital signal processor (DSP). All of the processing requires power as well. Designers frequently have to provide reduced or minimized computational designs to conserve power and to be able to accommodate all of the signal processing that the design must perform. Certain functions, such as acoustic feedback cancellation can be compromised in the effort to reduce processing overhead.

Accordingly, there is a need in the art for methods and apparatus for improved signal processing, and in particular for improved acoustic feedback cancellation for hearing assistance devices.

SUMMARY

Disclosed herein, among other things, are methods and apparatus for allocating feedback cancellation resources for improved acoustic feedback cancellation for hearing assistance devices. In various embodiments, a hearing assistance device includes a microphone and a processor configured to receive signals from the microphone and process them according to a plurality of processing blocks. The processor is adapted to include an event detector that can provide detection of an event and an output to adjust one or more processing blocks of the overall process to more efficiently use resources of the processor for the event detected, in various embodiments.

In various embodiments of the present subject matter, a method includes receiving signals from a hearing assistance device microphone processing the signals according to a plurality of processing blocks. An event is detected and one or more processing blocks are adjusted to more efficiently use resources for the event detected, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
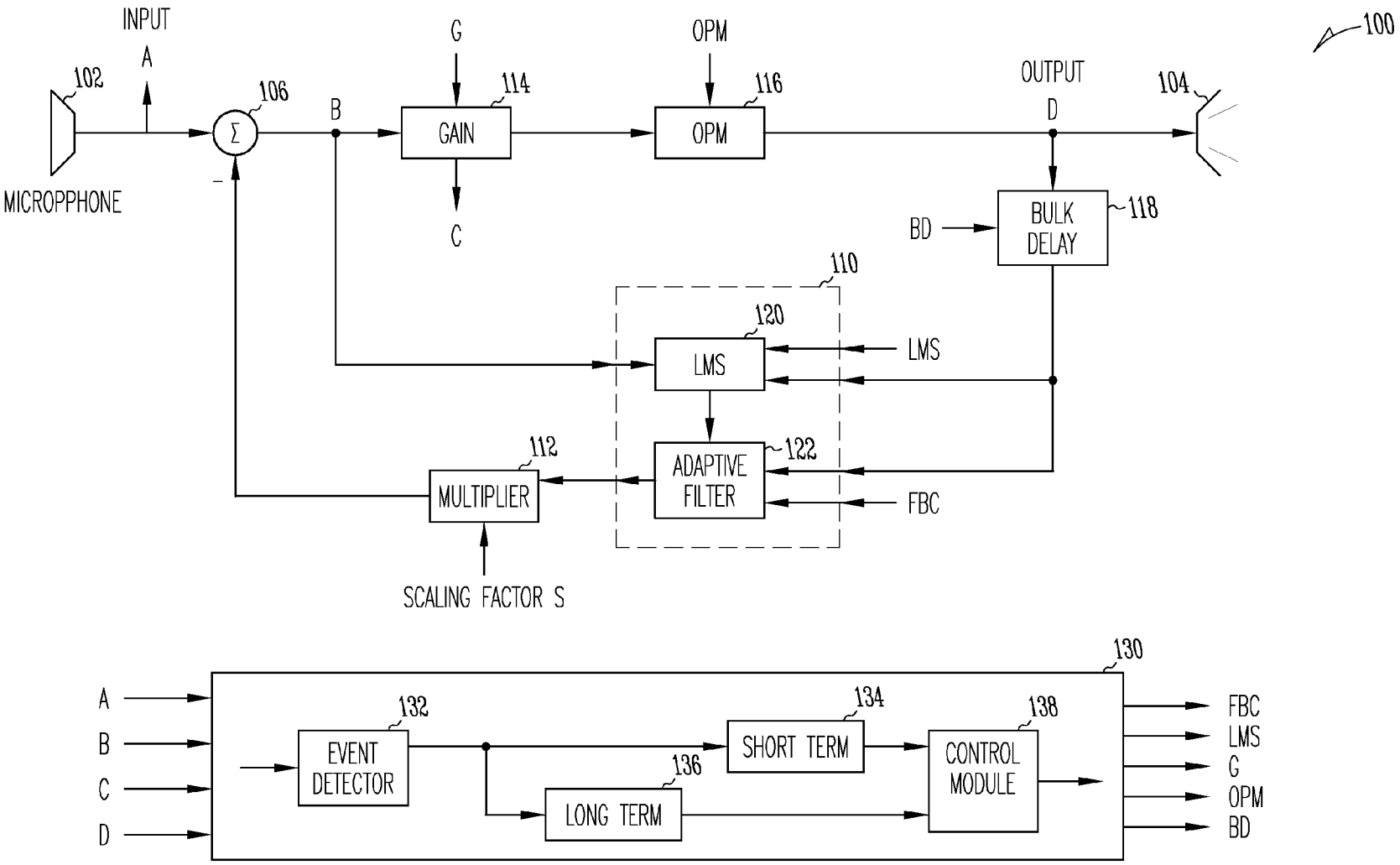
FIG. 1 shows a generalized block diagram of the present hearing assistance device system according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Disclosed herein, among other things, are methods and apparatus for allocating feedback cancellation resources for improved acoustic feedback cancellation for hearing assistance devices.

Hearing aids usually use an adaptive filter to implement a feedback canceller to eliminate acoustic and/or mechanical feedback. The adaptive filter performance is governed by a number of parameters or resources that are typically defined to optimize the performance for the desired application. The desired application in hearing aids is elimination of feedback. The feedback canceller parameters are also constrained to minimize undesired side-effects such as entrainment and other artifacts. (Entrainment is discussed in commonly owned and copending U.S. patent application Ser. No. 10/857,599, filed May 27, 2004, titled METHOD AND APPARATUS TO REDUCE ENTRAINMENT-RELATED ARTIFACTS FOR HEARING ASSISTANCE DEVICES, which is hereby incorporated by reference in its entirety. Also hereby incorporated by reference is commonly-owned U.S. Provisional Patent Application Ser. No. 60/473,844, filed May 27, 2003, titled METHOD AND APPARATUS TO REDUCE ENTRAINMENT-RELATED ARTIFACTS FOR HEARING AIDS.)

Since the DSP in a hearing aid has limited computational power, there is a desire to set the resources to the feedback canceller so as to minimize computational requirements. Ideally, there exists a set of parameters that provide best performance while satisfying all constraints. In reality, this is very difficult to achieve. Resources that provide good feedback elimination could result in increased artifacts and vice versa. Resource limitation due to computational power constraints affects the performance of the feedback canceller. To complicate things, depending on certain conditions the feedback canceller might require extra resources (to eliminate feedback) or reduced resources (to prevent entrainment).

Traditional approaches call for pre-determining the resources and parameters for the feedback canceller based on findings from in-house clinical studies. Even though the acoustic feedback and entrainment concerns differ for individuals a best guess solution that works for most people is chosen. Another option is to use fancy algorithms such as genetic algorithms that identify parameter values best suitable for the user. But, it is usually very hard to evaluate user preference for feedback cancellers because the requirement of resources (or values for parameters) might vary depending on input/acoustic leakage even for the same user.

This present approach provides a solution that takes into account the resources constraint in a small DSP while allowing a way to optimize the parameters and resources of the adaptive feedback canceller depending on what is best for the hearing aid at a given time instant. This approach increases performance of the feedback canceller while providing a reduced computational power. The approach involves detecting certain events that require adjustment to feedback canceller resources and determining better ways to manage the resources for such events.

One such event to detect and manage is the onset of feedback. Feedback can typically be detected at an early stage (for example, before it becomes annoying to the user) using a good feedback detector. In various embodiments, this detector operates individually on frequency bands. The detector can provide different types of information/data for each band of operation, including but not limited to dynamic feedback information and/or long-term feedback information. Dynamic feedback information is information that relates to the current status of feedback in the hearing aid. The system answers the question of whether feedback is happening or starting to happen. Long-term feedback information is measure of the probability of the feedback in a band, which we also refer to as "histogram data." Other types of information may be used without departing from the scope of the present subject matter.

The difference in the two types of information is primarily in the robustness/accuracy of the data. The dynamic feedback information is typically less robust because the detection criterion is very aggressive and can result in false detection of the onset of feedback (which we refer to as "false alarms"). Thus, there is always a competition between false alarms versus true detection of onset of feedback (which we also call a "hit"). The histogram data provides information on the long term probability of feedback. This data is usually more accurate because the detector can do a more detailed analysis due to more time to make a finding.

Feedback canceller resources can be controlled by utilizing these data. The dynamic feedback detection data is used to control resources in a temporary manner. This means that the resources are modified slightly to help minimize feedback but not by too much that it introduces audible artifacts. Also, the resource change is made for a short period of time to react to the feedback and is reverted back once the feedback has been controlled. The modification to resources could include increasing adaptation rate, increasing the feedback canceller dynamic range, reducing band gain etc. On the other hand, the long term information provides a more accurate picture of which bands require additional resources. The additional resources could significantly reduce the probability of feedback. These changes would be effective for longer duration and in some cases be made permanent if required. Some typical modifications include, but are not limited to increasing dynamic range, changing bulk delay, increasing number of taps/subband and/or combinations of these.

A feedback canceller design takes into consideration, among other things, elimination of acoustic feedback (which may also include other mechanical types of feedback modes), avoidance of audible artifacts arising from the adaptive cancellation, and a tolerable or reasonable amount of computational complexity. The present subject matter is directed toward balancing the resources and parameters of the feedback canceller to satisfy at least these three design aspects. It is capable of being implemented in the time domain, in the frequency domain, or in the subband domain.

In one embodiment of the present subject matter, the design monitors and endeavors to adjust (and optimize if possible) one or more of the following, including, but not limited to: the number of filter coefficients, the adaptation rate of the feedback canceller, the gain on the hearing aid, the phase shift rate (or frequency shift amount) to control entrainment, the decimation of feedback canceller filter update, the scaling factor at the output of the feedback canceller, the scaling factor at the output of the feedback canceller, and the bulk delay of the feedback canceller.

It is understood that the number of coefficients can be changed in the time domain, in the subband domain, or in the frequency domain. Accordingly, the more feedback is detected the greater number of taps that can be allocated to the cancellation effort. The less feedback, the less number of taps are needed. This decreases computational complexity.

A number of factors determine how these resources will be adjusted. To avoid introducing any audible artifacts care must be taken on when and how much the resources need to be updated. The present subject matter is generally performed in two stages. The first is a detection of an event that requires change in resources, and then an adjustment is performed in response to the event detected.

In various embodiments, an event will include anything that requires a change in the feedback canceller. In one exemplary system this means a simplified set of events includes (but is not limited to) a feedback event, an entrainment event (also known as a "bias" experienced by the adaptive filter) or a detection of quiet. The detection of the event can be a wideband or a narrowband computation. The response to the event can involve selective changes in resources to certain bands or to the entire frequency range. There is no absolute rule when it comes to controlling resources. For example, some events require increasing resources in one band but might require decreasing the same resources in a different band. The resources can be independently varied in different bands in response to the detection of an event.

Detections of an event should be fast and robust. The response should produce little or no audible artifacts, and adopt where possible a simple logic to provide a quick, simple and smooth transition to the original resource state following the event.

FIG. 1 shows a generalized block diagram of the present hearing assistance device system according to various embodiments of the present subject matter. The following convention is adopted: arrows to a block indicate inputs and arrows from a block are outputs and may be labeled. The hearing assistance device 100 includes a microphone 102 that produces a signal A which is the input to the signal processing channel of the device (which is generally all of the blocks between the input A and the output D). It is understood that the implementation of the signal processing channel can be a time domain implementation, a frequency domain implementation, a subband domain implementation, or combinations thereof. Therefore, well known individual analog-to-digital, frequency analysis, and/or time-to-frequency conversion blocks will not be shown.

The output of the device D is provided to speaker 104 (also known as a receiver in the hearing aid art). Signals from the input are sent to summer 106 and subtracted from a signal X which is a multiplied version of the output of the acoustic feedback canceller block 110 via multiplier 112. Multiplier 112 receives a scaling factor S that allows it to scale the output of the acoustic feedback canceller block 110 so that the feedback canceller block 110 can use linear gain adjustments, and compensates for floating point calculations that allow for higher resolution correction.

The output of summer 106 is signal B which is provided to the gain block 114. In hearing aid applications, gain block 114 will provide programmable gain to the input signal to compensate for hearing loss. The coefficients of the gain block 114 can be retrieved from output C and parameters can be sent to the block using input G. The output of the gain block is optionally fed into an output phase modulation block 116 which accepts input OPM to adjust the operation of that block. The operation of the OPM block provides adjustable phase shift which includes but is not limited to the disclosure described in copending, commonly owned patent applications U.S. patent application Ser. No. 11/276,763, filed Mar. 13, 2006, titled OUTPUT PHASE MODULATION ENTRAINMENT CONTAINMENT FOR DIGITAL FILTERS and U.S. patent application Ser. No. 12/336,460, filed Dec. 16, 2008, titled OUTPUT PHASE MODULATION ENTRAINMENT CONTAINMENT FOR DIGITAL FILTERS, that are both hereby incorporated by reference in their entirety. The output of block 116 is provided to receiver 104 and to bulk delay 118. Bulk delay provides a programmed delay and includes, but is not limited to the disclosure set forth in commonly owned U.S. Pat. No. 7,386,142, field May 27, 2004, titled METHOD AND APPARATUS FOR A HEARING ASSISTANCE SYSTEM WITH ADAPTIVE BULK DELAY, and in commonly owned and copending U.S. patent application Ser. No. 12/135,856 filed Jun. 9, 2008, titled METHOD AND APPARATUS FOR A HEARING ASSISTANCE SYSTEM WITH ADAPTIVE BULK DELAY, which are both hereby incorporated by reference in their entirety. The output of the bulk delay 118 is provided to acoustic feedback canceller 110 and in particular to the adaptive filter algorithm section 120 which is called "LMS" in FIG. 1, but is not limited to an LMS algorithm. Other algorithms may be used without departing from the scope of the present subject matter including, but not limited to LMS algorithms and their variants (some examples include, but are not limited to sign-sign, normalized LMS, and filtered-X LMS), affine projection algorithms and their variants, and recursive least squares algorithms and their variants. The output of bulk delay 118 is also provided to adaptive filter 122. The algorithm section 120 also gets output B from summer 106.

The present system also has an event manager 130 which is generalized as being able to use one or more of the inputs A, B, C, and/or D in any combination and provide event detection using detector 132, and to process detected events using short term module 134 and/or long term module 136. The output of modules 134 and 136 are provided to control module 138. The event manager 130 can take the output of control module 138 and use it to provide changes to any one or more of the following outputs: FBC, LMS, G, OPM, and BD. Thus, the design is highly programmable and can detect and address events using a plurality of inputs and outputs or subsets of them. It is understood that the inputs and outputs of event manager 130 can vary without departing from the teachings of the present subject matter.

Event detector 132 can perform any statistical measure needed. Furthermore, it understood that a plurality of event detectors can be employed to provide specialized processing of different events. For example, three event detectors 132 can be employed; one for feedback cancellation, one for entrainment (filter bias) management, and one for quiet detection. The event detectors can each provide different outputs for different or similar parts of the hearing assistance device 100.

The short term module 134 is adapted to detect short term events and provide signals to the control module 138 to identify them. The long term module 136 is adapted to provide long term information (histogram) to the control module 138. In some applications only the short term module 134 or only the long term module 136 may be used. Consequently, control module 138 acts like a resource manager to provide inputs to various resources of the hearing assistance device processing channel. It is understood that a number of different input and output configurations are possible with the present system. Thus, the configuration of the present system can be changed accordingly to accommodate a great number of applications.

Figure 2:
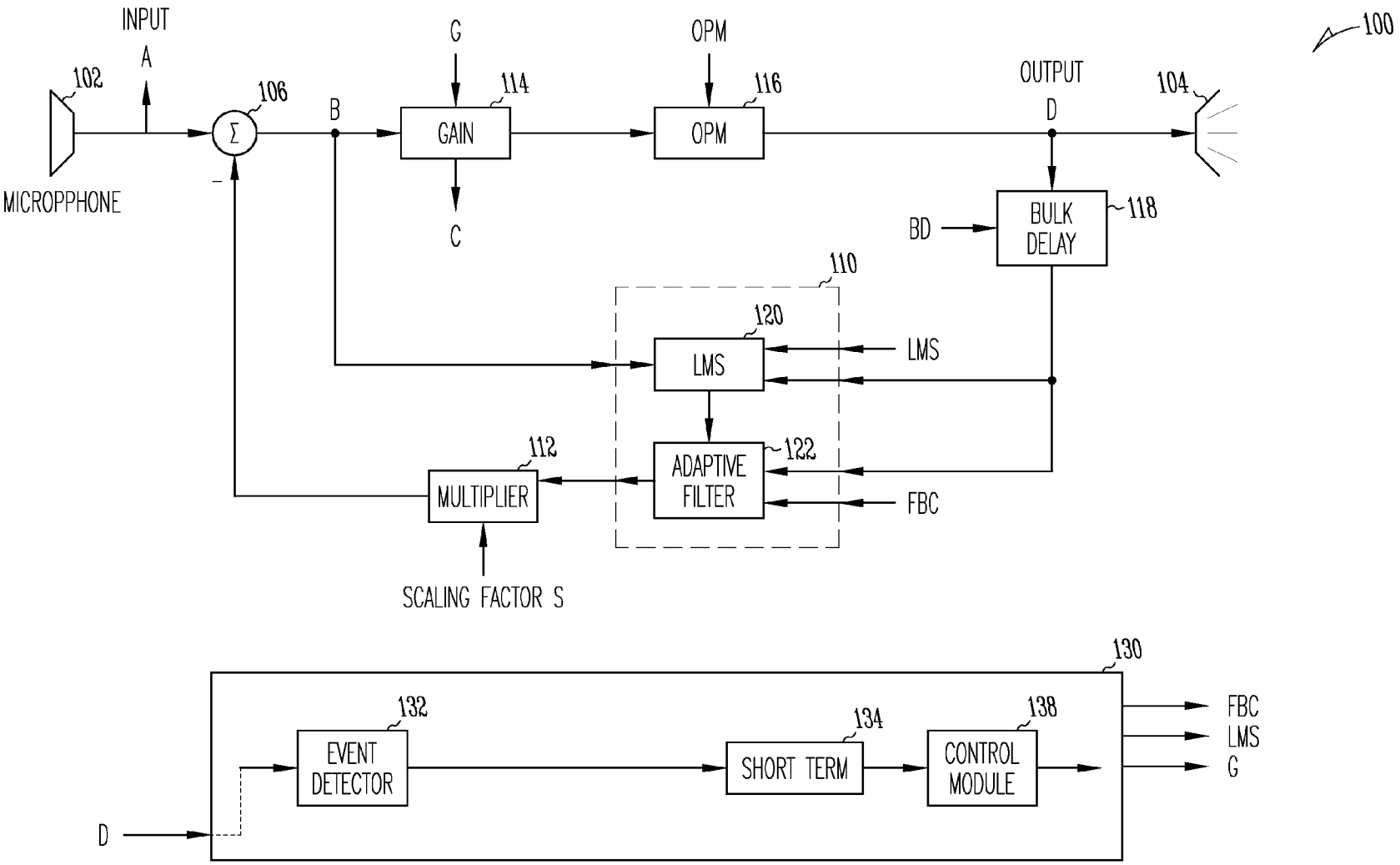
FIG. 2 shows a specific block diagram of a hearing assistance device system according to various embodiments of the present subject matter.

FIG. 2 shows a specific block diagram of a hearing assistance system according to various embodiments of the present subject matter. This specific configuration is adapted to demonstrate how the acoustic feedback canceller could be enhanced by decreasing the number of coefficients during "quiet" detection.

FIG. 2 shows that the input to the event manager 130 is the output D. This configuration only uses the short term module 134 to provide signals to the control module 138. The resulting output of control module 138 could be used to decrease the amount of coefficients used by acoustic feedback canceller module 110 using inputs FBC and LMS and to decrease the overall gain applied to the input signal during the quiet using input G to gain block 114. Of course, this is only one way the event manager 130 can be configured.

Figure 3A:
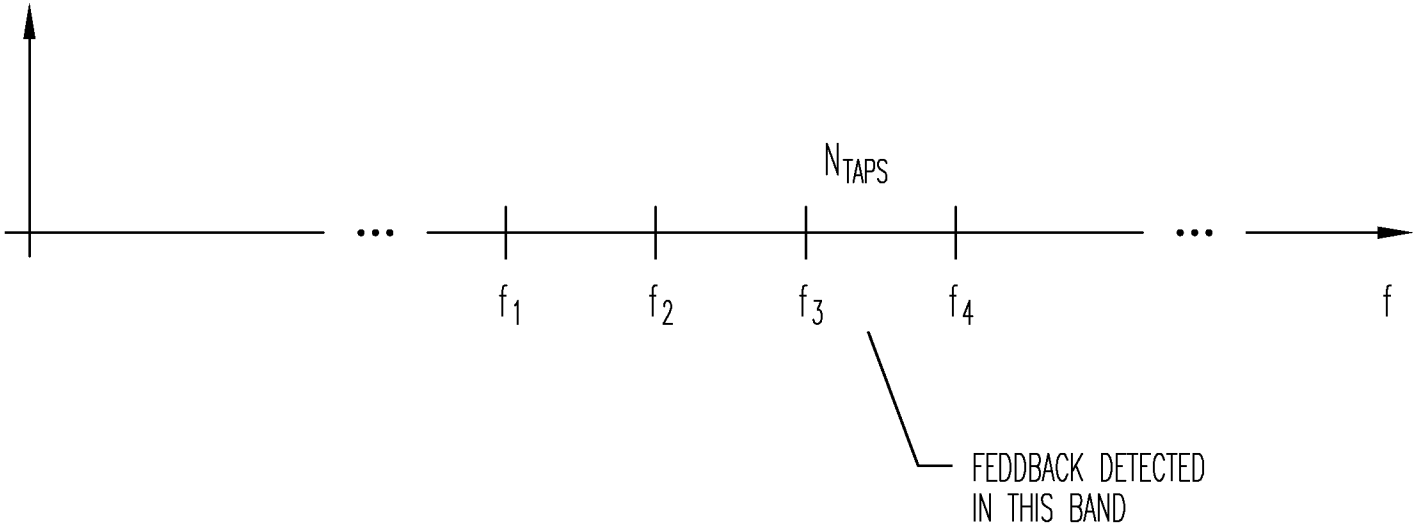
FIGS. 3A and 3B show a filter configuration before and after feedback detection to provide an example of increasing the number of filter coefficients when feedback is detected according to one embodiment of the present subject matter.
Figure 3B:
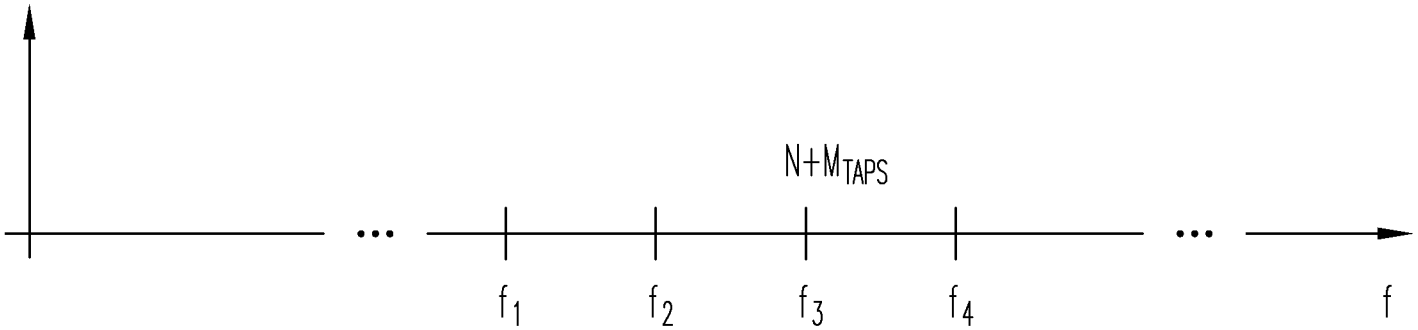

The system is programmable for a number of different signal processing tasks. FIGS. 3A and 3B show a filter configuration before and after feedback detection to provide an example of increasing the number of filter coefficients when feedback is detected according to one embodiment of the present subject matter. The system can detect feedback in a certain band (in this example, between F3 and F4) and then the system adjusts the coefficients to more accurately cancel feedback in that band. Therefore, the coefficients are changed from N taps in the filter of FIG. 3A to N+M taps in the filter of FIG. 3B in the band between F3 and F4. This example only demonstrates some of the ability of the present system to allocate processing resources based on sensed events. The present system is highly programmable, and as such many other applications are possible with the present system. Many other approaches are possible using the system which are too numerous to enumerate herein.

It is understood that in digital signal processing implementations of the present subject matter that the processing shown in FIGS. 1 and 2 can be accomplished by the DSP and that the functions are performed as a result of firmware that programs the DSP accordingly. It is possible that some aspects may be performed by other hardware, software, and/or firmware. Consequently, the system set forth herein is highly configurable and programmable and may be used in a variety of implementations.

The present subject matter can be used for a variety of hearing assistance devices including, but not limited to tinnitus masking devices, assistive listening devices (ALDs), cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

a microphone; and a processor configured to receive signals from the microphone and process them according to a plurality of processing blocks, the processor including a feedback canceller and an event manager, the event manager including:

an event detector configured to provide detection of an event that can effect performance of the feedback canceller;

a short term module configured to process short term events detected by the event detector;

a long term module configured to process long term events detected by the event detector; and a control module configured to adjust one or more processing blocks of the overall process using outputs of the short term and long term modules to more efficiently use resources of the feedback canceller for the event detected.

2. The device of claim 1, wherein the control module is configured to adjust a number of filter coefficients.

3. The device of claim 1, wherein the control module is configured to adjust an adaptation rate of the feedback canceller.

4. The device of claim 1, wherein the control module is configured to adjust a phase shift rate to control entrainment.

5. The device of claim 1, wherein the control module is configured to adjust a scaling factor at an output of the feedback canceller.

6. The device of claim 1, wherein the control module is configured to adjust a bulk delay of the feedback canceller.

7. The device of claim 1, wherein the hearing assistance device includes a cochlear implant.

8. The device of claim 1, wherein the hearing assistance device includes a hearing aid.

9. The device of claim 8, wherein the hearing aid includes a behind-the-ear (BTE) hearing aid.

10. The device of claim 8, wherein the hearing aid includes an in-the-ear (ITE) hearing aid.

11. The device of claim 8, wherein the hearing aid includes an in-the-canal (ITC) hearing aid.

12. The device of claim 8, wherein the hearing aid includes completely-in-the-canal (CIC) hearing aid.

13. The device of claim 8, wherein the hearing aid includes a receiver-in-the-canal (RIC) hearing aid.

14. The device of claim 8, wherein the hearing aid includes a receiver-in-the-ear (RITE) hearing aid.

15. A method of operating a hearing assistance device, the method comprising:

receiving signals from a microphone of the hearing assistance device;

processing the signals according to a plurality of processing blocks, including using a feedback canceller;

detecting an event that can effect performance of the feedback canceller using an event detector, including identifying and classifying short term events and long term events;

processing short term events detected by the event detector using a short term module and separately processing long term events detected by the event detector using a long term module; and adjusting one or more processing blocks using outputs of the short term module and the long term module, to more efficiently use resources for the event detected.

16. The method of claim 15, wherein adjusting one or more processing blocks includes a time domain implementation.

17. The method of claim 15, wherein adjusting one or more processing blocks includes a frequency domain implementation.

18. The method of claim 15, wherein adjusting one or more processing blocks includes a subband domain implementation.

19. The method of claim 15, wherein adjusting one or more processing blocks includes adjusting a number of filter coefficients, an adaptation rate of a feedback canceller, a gain of the hearing assistance device, a phase shift rate to control entrainment, decimation of feedback canceller filter update, a scaling factor at an output of a feedback canceller, or a bulk delay of a feedback canceller.

20. The system of claim 15, wherein the hearing assistance device includes a behind-the-ear (BTE) hearing aid, an in-the-ear (ITE) hearing aid, an in-the-canal (ITC) hearing aid, a completely-in-the-canal (CIC) hearing aid, a receiver-in-the-canal (RIC) hearing aid or a receiver-in-the-ear (RITE) hearing aid.

* * * * *